US011692427B2

(12) United States Patent
Al-Qasim et al.

(10) Patent No.: US 11,692,427 B2
(45) Date of Patent: Jul. 4, 2023

(54) SYSTEMS AND METHODS FOR PROCESSING DOWNHOLE FLUIDS

(71) Applicant: Saudi Arabian Oil Company, Dhahran (SA)

(72) Inventors: Abdulaziz S. Al-Qasim, Dammam (SA); Hattan M. Banjar, Dhahran (SA); Amer Alanazi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 71 days.

(21) Appl. No.: 17/350,263

(22) Filed: Jun. 17, 2021

(65) Prior Publication Data

US 2022/0403726 A1 Dec. 22, 2022

(51) Int. Cl.

| | |
|---|---|
| ***E21B 43/38*** | (2006.01) |
| ***E21B 43/40*** | (2006.01) |
| ***E21B 43/12*** | (2006.01) |

(52) U.S. Cl.

CPC ..... *E21B 43/38* (2013.01); *E21B 43/128* (2013.01); *E21B 43/40* (2013.01)

(58) Field of Classification Search

CPC ..... E21B 43/38; E21B 43/385; E21B 43/40
See application file for complete search history.

(56) References Cited

U.S. PATENT DOCUMENTS

| | | | | |
|---|---|---|---|---|
| 5,033,545 A * | 7/1991 | Sudol | E21B 43/124 134/167 C |
| 5,762,149 A | 6/1998 | Donovan et al. | |
| 5,992,521 A * | 11/1999 | Bergren | E21B 43/124 166/372 |
| 6,039,116 A | 3/2000 | Stevenson et al. | |
| 6,092,600 A | 7/2000 | McKinzie et al. | |
| 6,123,149 A | 9/2000 | McKinzie et al. | |
| 6,131,655 A * | 10/2000 | Shaw | E21B 43/385 166/54.1 |
| 6,189,613 B1 * | 2/2001 | Chachula | E21B 43/35 166/265 |
| 11,199,080 B2 * | 12/2021 | Raglin | B01D 33/275 |
| 11,506,033 B2 * | 11/2022 | Tang | E21B 43/121 |
| 2011/0079388 A1 * | 4/2011 | Cox | E21B 43/38 166/266 |

(Continued)

FOREIGN PATENT DOCUMENTS

EP 1103698 A1 5/2001

OTHER PUBLICATIONS

Anthony, E. and Al-Mosaileekh, First Downhole Water Sink with ESP Improves Oil Recovery and Production Rates for KOC, Schlumberger, 2 pages (2018).

(Continued)

*Primary Examiner* — Shane Bomar
(74) *Attorney, Agent, or Firm* — Osha Bergman Watanabe & Burton LLP

(57) ABSTRACT

A fluid processing system is configured for use in a wellbore in a hydrocarbon-bearing rock formation. The system includes a casing liner disposed in an open hole section of a well for providing a separation zone in a flow of materials from a first reservoir The system includes a downhole separator operatively coupled to the casing liner for separating the first material and the second material within the flow of materials. The flow of materials includes at least a first material and a second material.

18 Claims, 13 Drawing Sheets

(56) References Cited

U.S. PATENT DOCUMENTS

| | | | | |
|---|---|---|---|---|
| 2012/0043088 | A1 | 2/2012 | McAllister et al. | |
| 2015/0369229 | A1* | 12/2015 | Xiao | F04C 13/008 417/54 |
| 2017/0022795 | A1* | 1/2017 | Joshi | E21B 43/38 |
| 2018/0003015 | A1* | 1/2018 | Muraikhi | E21B 43/124 |
| 2018/0112509 | A1 | 4/2018 | Saponja et al. | |
| 2018/0156021 | A1* | 6/2018 | Ayub | E21B 43/121 |
| 2020/0378235 | A1* | 12/2020 | Gonzales | E21B 43/35 |
| 2020/0386086 | A1* | 12/2020 | Koli | E21B 21/08 |
| 2022/0212964 | A1* | 7/2022 | Soliman | B01D 61/002 |

OTHER PUBLICATIONS

Anthony, E. and Al-Mosaileekh, S., Downhole Water Sink Technology Improves Recovery and Rates from Strong Water Drive Reservoirs in North Kuwait—A Pilot Cast Study, Inter. Petro. Tech. Conf., IPTC-18754-MS, 16 pages (2016).

Davies, D. R. et al., Analysis of Possible Applications of Dual ESPs—A Reservoir Enginerring Perspective, Soc. Petro. Engin., SPE99878, 11 pages (2006).

Elaila, S. Z. et al., Subsurface Disposal of Produced Water and Simultaneous Increased Oil Production Achieved within the Same Wellbore Using Inverted ESP—North Kuwait Case Study, Soc. Petro. Engin., SPE-187624-MS, 19 pages (2017).

Jin, L. and Wojtanowicz, A. K., Performance Analysis of Wells With Downhole Water Loop Installation for Water Coning Control, Jrnl. Cana. Petro. Tech., 49(6):38-44 (2010).

No authors listed, Simultaneously Producing Oil and Injecting Water Saves KOC at Least USD 4 Million, Schlumberger, 2 pages (2018).

Shirman, E. I. and Wojtanowicz, A. K., More Oil Using Downhole Water-Sink Technology: A Feasibility Study, SPE Prod. Fac., 15(4):234-240 (2000).

Lea, James F., et al. "What's New in Artificial Lift", World Oil, Gulf Publishing Compagny, vol. 218, No. 4, Apr. 1997, pp. 1-6, [6 Pages].

International Search Report and Written Opinion issued in corresponding PCT International Application No. PCT/IB2021/056414 dated Mar. 22, 2022 (5 pages).

* cited by examiner

SYSTEMS AND METHODS FOR PROCESSING DOWNHOLE FLUIDS

TECHNICAL FIELD

This specification describes systems and methods for use in a wellbore to process fluids in hydrocarbon-bearing rock formations.

BACKGROUND

Fluid production from hydrocarbon bearing rock formation may require management of water or other undesired components in the production fluids. Early water encroachments and associated high water cut (fraction of water) in produced fluids presents challenges to the oil recovery process at the surface and subsurface. An increase in the water production may increase the cost to maintain or upgrade surface water-handling facilities to handle the excessive amount of produced water because water may cause corrosion in the fluid handling equipment and may need to be separated from the oil in a potentially costly process. Moreover, injecting the produced water back into the formation after separation may present challenges because only a limited amount of water may be needed to be injected into the reservoir and because the formation may be unsuitable for injection of the separated water. Water handling systems may be deployed to manage water encroachment in wellbores in hydrocarbon bearing rock formations. Reducing encroachment may in turn reduce the amount of energy needed for water handling facilities and ultimately reduce the carbon foot print and related emissions of such facilities.

SUMMARY

An example fluid processing system for use in a wellbore in a hydrocarbon-bearing rock formation includes a casing liner disposed in an open hole section of a well for providing a separation zone in a flow of materials from a first reservoir. The flow of materials includes at least a first material and a second material. The example fluid processing system includes a downhole separator operatively coupled to the casing liner for separating the first material and the second material within the flow of materials.

The system may include an artificial lift system operatively coupled to the downhole separator. The artificial lift system may be disposed within the well for lifting at least one of the first and second materials uphole through the well or for injecting at least one of the first and the second materials into a second reservoir. the artificial lift system may be or may include at least one of an electrical submersible pump (ESP) and an inverted ESP.

The second reservoir may be located at a greater depth than the first reservoir. The first reservoir and the second reservoir may be lateral reservoirs. The first material may be or may include oil. The second material may be or may include gas or water. The downhole separator may be or may include at least one of a hydro cyclone and a water sink.

The downhole separator may separate the flow of materials in a substantially horizontal direction. The downhole separator may separate the flow of materials in a substantially vertical direction. The downhole separator may include a separation barrier. The separation barrier may be movable within the downhole separator. The separation barrier may be movable based on a ratio of an amount of the first material to the second material. The downhole separator may be disposed at the open hole section of the well.

An example method for processing materials in a wellbore in a hydrocarbon-bearing rock formation includes drilling a wellbore. The wellbore is operatively coupled to a flank of a first reservoir and a flank of a second reservoir. The method includes separating a flow of materials into at least a first material and a second material. The flow of materials enters the well through the flank of the first reservoir. The method includes pumping at least one of the first material and the second material through the well. The method includes injecting the second material into the second reservoir.

The first reservoir may be located at a greater depth than the second reservoir. The flow of materials may include at least one of oil, water, and gas. The first material may be or may include oil. The second material may be or may include gas or water.

Separating a flow of materials may include using at least one downhole separator. Pumping the first material uphole through the well and injecting the second material into the second reservoir may include using an artificial lifting system. The artificial lifting system may be or may include at least one of an ESP and an inverted ESP.

The details of one or more implementations are set forth in the accompanying drawings and the description. Other features and advantages will be apparent from the description and drawings, and from the claims.

DETAILED DESCRIPTION

Figure 1A:
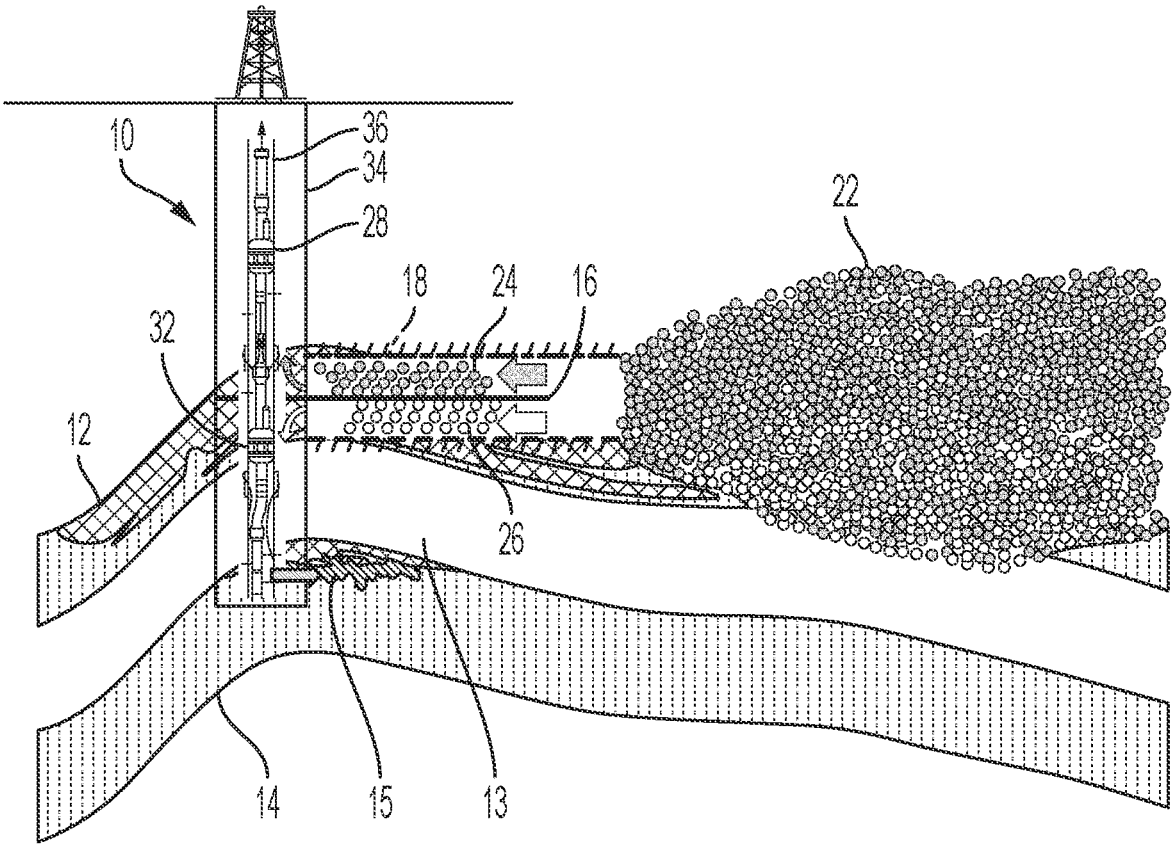
FIG. 1A is a cross-sectional view of a system with an electrical submersible pump (ESP), an inverted ESP, and a horizontal casing liner with separator for processing downhole fluids from an upper reservoir and for injecting fluid into a lower reservoir of a hydrocarbon-bearing rock formations, according to aspects of the present embodiments.

In hydrocarbon reservoirs (for example, fractured and/or carbonate reservoirs), coning or cusping are commonly observed phenomena. Coning generally refers to a change in oil-water contact or gas-oil contact profiles because of drawdown pressures during production. Coning may occur in vertical or slightly deviated wells and may be affected by the characteristics of the fluids involved and the ratio of horizontal to vertical permeability. Cusping generally refers to production of aquifer water that flows (in)to a production well through inclined geological strata or zones, or gas-cap gas that flows to the production well through inclined geological strata. Coning or cusping in water or gas may cause early fluid breakthrough that may result in an increase in the cost for oil production. As oil fields mature with time, excessive gas or water production may increase to an undesired threshold that may decrease the oil production rate and eventually damage the well. To overcome these challenges, systems and methods as described in this specification may be deployed that may reduce the need or cost for surface handling facilities, increase oil production (for example, to more than 90%), or maintain healthy reservoir conditions.

The systems and methods described in this specification are based at least in part on a synergistic process to combine one or more downhole fluid separation systems with artificial lift technology. Coupling the benefits of artificial lifting and with sophisticated downhole separation systems may result in arresting water increase and unlocking more oil for conveyance to the surface.

The example embodiments described in this specification may exhibit a number of benefits. First, the technologies described in this specification may help minimize or eliminate the need for current water handling facilities and thus may reduce or eliminate associated costs. Second, the technologies described in this specification may help maximize the oil production rate and the productivity output of a well and extend the life of the reservoir. Third, the technologies described in this specification may increase, stabilize, or support the pressure of a reservoir/aquifer through injecting recycled water back into the reservoir. Fourth, the technologies described in this specification may help limit any need for water injection facilities and may help maximize and expedite field development. Fifth, the technologies described in this specification may provide or may improve delivery of water to reservoirs in remote areas where water is not available. Sixth, the technologies described in this specification may help reduce the environmental impact of oil production by reducing energy expenditure and waste. Seventh, the technologies described in this specification may eliminate the need for drilling an injector at a lower or bottom reservoir, which may reduce overall costs of production. Eighth, the technologies described in this specification may help reduce excessive gas production, associated operation expenses (OPEX), and fluid separation-associated costs. Ninth, the technologies described in this specification may help reduce flaring activities at gas-oil separation plants, thus reducing impact of such plants on the environment.

The present disclosure may include intelligent systems and methods for processing downhole fluids in a formation, for example, formations with excessive water and/or gas production. The disclosed embodiments may efficiently separate fluids (for example, oil, gas, water, or combinations of oil, gas, and water). The disclosed embodiments may include technologies to identify an injection zone in which excessive fluids (for example, gas or water) may be injected without causing circulation or without losing the water's potential energy by injecting it to a formation that is relatively close to the producing formation.

The systems and methods described in this specification may be used to separate and inject excessive fluids (for example, gas or water, or both) into a lower part of a production zone (for example, reservoir) and help lift oil to the surface. The separated fluids (for example, gas or water, or both) may be diverted to any part to the wellbore. The systems and methods in the disclosed embodiments may also be used in other formations (for example, natural gas fields).

This specification describes systems and methods for processing downhole fluids in hydrocarbon-bearing rock formations. The system may include a casing liner, a downhole separator (for example, a hydro-cyclone) operatively coupled to the casing liner, and may include an artificial lift system. The systems and methods may be used in a dual or multiple reservoirs. In some embodiments, systems and methods may be used in a dual reservoirs including a top (or upper) reservoir and a bottom (or lower) reservoir. An example bottom reservoir may include a distinctive water or gas zone, for example, at the reservoir's flank. Example methods may include drilling a well for producing oil from a top reservoir. Example methods may include drilling a well at a phase contact (for example, oil-water or oil-gas contact) of a bottom reservoir and injecting water or gas into the flank or vicinity of the phase contact of the bottom reservoir. Injected water may be water removed from the top reservoir and injected into the bottom reservoir. Water injected into the bottom reservoir may support the pressure of reservoirs, improve well performance, and minimize cost for treating facilities in remote offshore or onshore areas.

FIGS. 1-5 and 12 are cross-sectional views of an example fluid processing system 10 for processing downhole fluids 22 in hydrocarbon-bearing rock formations, according to aspects of the present embodiments. An example fluid processing system 10 may include a casing liner 18 disposed in a (lateral) open hole section of a well 34 or in fluid connection with a well 34. In some embodiments, a casing liner 18 may provide a separation zone for downhole fluids 22 entering from a first reservoir 12. An example fluid processing system 10 may include a downhole separator 16. In some embodiments, downhole separator 16 may be operatively coupled to a horizontal casing liner 18 for separating downhole fluids 22 into a first material 24 and a second material 26. In some specific embodiments, downhole separator 16 may be integrated into a horizontal casing liner 18. The downhole fluids 22 may include oil, water, gas, or a combination of two or more of oil, water, and gas. In some example embodiments, a first material 24 may include oil and a second material 26 may include water. In some embodiments, a downhole separator, for example, downhole separator 16, may be disposed in a substantially vertical section of well 34, for example, at or near a joint connecting casing liner 18 with well 34. An example fluid processing system 10 may include an artificial lift system 36 operatively fluidly coupled to the downhole separator 16, where the artificial lift system 36 is disposed within the well 34. In some embodiments, artificial lift system 36 is for lifting at least one of the first and second materials, 24 and 26, uphole through the well 34. In some embodiments, artificial lift system 36 is for injecting at least one of the first and the second materials, 24 and 26, into a second reservoir 14. First reservoir 12 and second reservoir 14 may be separated by an insulating layer 13. The artificial lift system 36 may include at least one of an electrical submersible pump (ESP) 28 and an inverted ESP 32.

A wellbore, for example, well 34, may be drilled in a first reservoir 12 and a second reservoir 14. The first reservoir 12 and/or the second reservoir 14 may include lateral sections of different shape, size, or depth. Fluids in reservoirs 12 and 14 may differ from each other in terms of properties of fluids in the reservoirs. A wellbore, for example, well 34, may be or may include a vertical main bore or mother bore. A wellbore, for example, well 34, may be or may include a dual lateral bore well (for example, a horizontal mother bore and a lateral sub-bore), or a multi-lateral bore well (for example, a horizontal mother bore and multilateral sub-bores). In some embodiments, in the case of a multilateral well, additional laterals may be used as production zones for replicating an upper lateral bore (for example, the first reservoir 12), or as injection zones for replicating a lower lateral bore (for example, the second reservoir 14). In some embodiments, a vertical section of a mother bore may be coupled to a production ESP, an injection ESP, or a gas compressor, together with hydro-cyclone(s), for example, to enhance separation quality.

Figure 12:
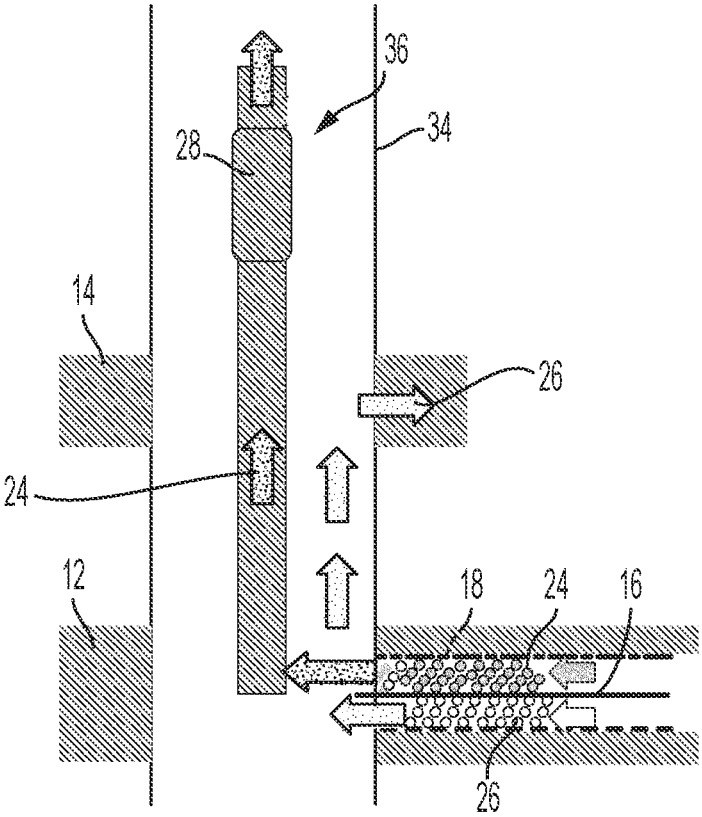
FIG. 12 is a cross-sectional schematic view of a system with an artificial lift system and a horizontal casing liner with separator for processing downhole fluids from first reservoir and for injecting fluid into a second reservoir above the first reservoir, according to aspects of the present embodiments.

A wellbore, for example, well 34, may be especially drilled such that an upper part of a wellbore may be in contact with (a lateral section of) the first reservoir 12 where oil and (water/gas) may be produced, while a lower part may be in contact with an aquifer and/or gas cap of the second reservoir 14 where separated water (or gas) from the upper reservoir can be injected. The upper part may be situated uphole of the lower part. In some embodiments, vertical sections, deviated sections, or sections located within a few hundred feet (for example, 100-500 feet) after kickoff points of the well (branching points of a wellbore) may include casing, while lateral sections of a wellbore, for example, well 34, may include perforations or open hole lateral wells. In some embodiments, a first reservoir 12 may be located at a greater depth than a second reservoir 14, as shown in FIG. 12. In some embodiments, a second reservoir 14 may be located at a greater depth than a first reservoir 12, as shown in FIG. 1A, for example.

An oil field may produce oil from one or more reservoirs from a single wellbore for example, well 34, or multiple wellbores, for example, as described infra. Each reservoir (for example, reservoirs 12 or 14) may be separated and/or sealed by rock formation. Fluids in each reservoir (for example, reservoirs 12 or 14) may include oil, water, gas, or a combination thereof. A reservoir (for example, reservoirs 12 or 14) may need a power water injector that drains water from a reservoir or other supply and injects water to a bottom of the a reservoir to support pressure in the reservoir and to pump the oil. A wellbore, for example, well 34, may be drilled at a phase contact point (for example, oil-water or oil-gas contact) of a lower reservoir (for example, the second reservoir 14) for producing oil from an upper reservoir (for example, the first reservoir 12) and injecting water or gas (or both) into a flank or vicinity of a phase contact of the lower reservoir (for example, oil/water contact line 17 in second reservoir 14). Injecting water or gas (or both) into a flank or vicinity of a phase contact in the lower reservoir may support the pressure, improve well performance of the second reservoir, and minimize cost for treating facilities in remote offshore or onshore areas.

Referring to FIG. 1A, an artificial lift system 36 may include both an ESP 28 and an inverted ESP 32. ESP 28 may push the first material 24 (for example, oil) from first reservoir 12 upward through the well 34. Inverted ESP 32 may pump (excessive) second material 26 (for example, water or gas) from first reservoir 12 to a lower zone (for example, the second reservoir 14). Second reservoir 14 may be generally located at a greater depth than first reservoir 12. In some embodiments, second reservoir 14 may be a bottom or lower reservoir and first reservoir 12 may be a top or upper reservoir. Horizontal casing liner 18 may include a downhole separator 16 for separating downhole fluids 22 into a first material 24 and a second material 26. First material 24 may be directed to ESP 28 for pumping to the surface, and second material 26 may be directed to inverted ESP 32 for pumping/injecting into second reservoir 14, for example, at a water injection zone 15.

Figure 1B:
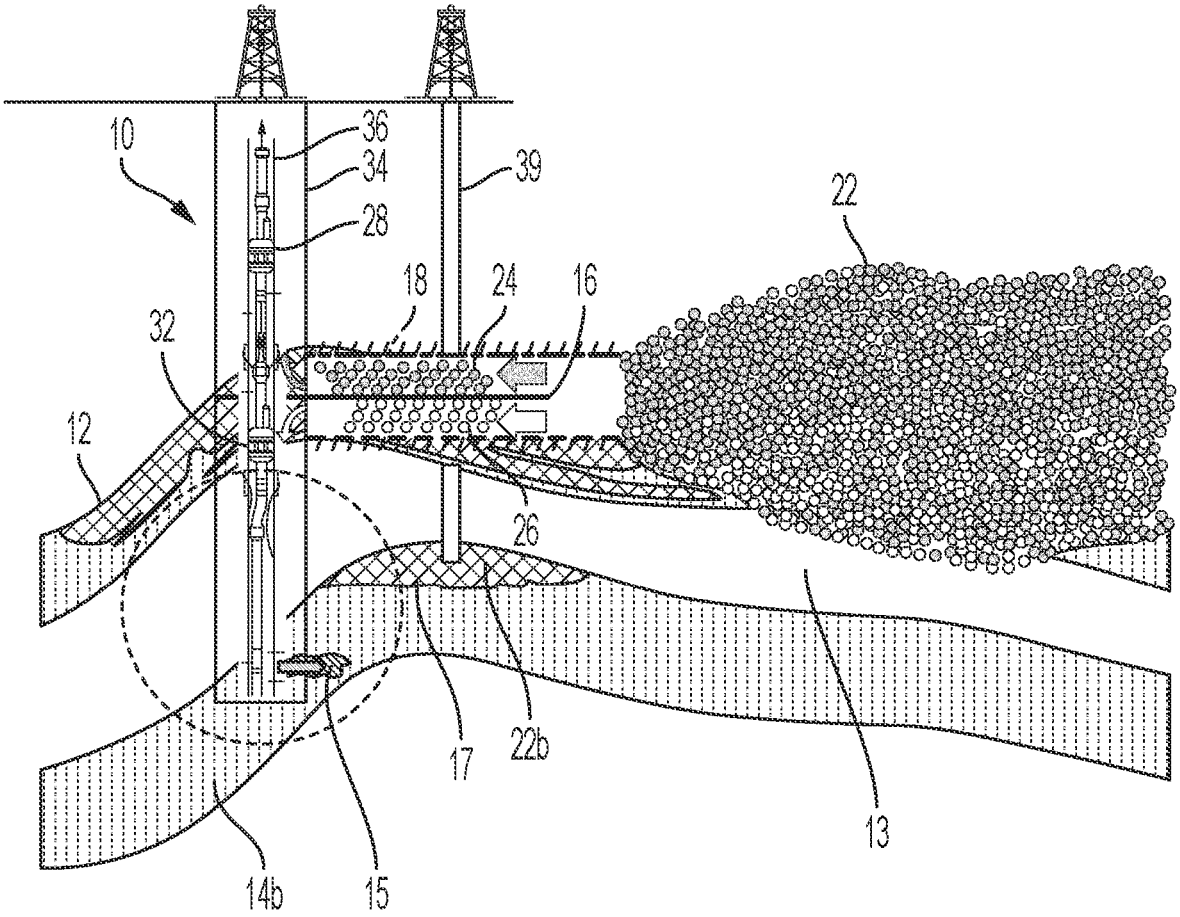
FIG. 1B is a cross-sectional view of the same system with a secondary wellbore to extract fluids from the lower reservoir.

In some embodiments, water may be injected into one or both of the first reservoir 12 and the second reservoir 14. In some embodiments, water separated from downhole fluid 22 may be injected into both first reservoir 12 and second reservoir 14. The injected water may support an oil column one or both of first reservoir 12 and second reservoir 14. In some embodiments, for example, as illustrated in FIG. 1A, second material 26 (for example, water) separated from downhole fluid 22, may be injected into second reservoir 14 for example, at a water injection zone 15. In some embodiments, for example, as illustrated in FIG. 1B, second material 26 (for example, water) separated from downhole fluid 22, may be injected into second reservoir 14 near or below a water/oil contact line 17 between a (lower) water layer and a layer including a downhole fluid 22*b*, for example, oil or an oil-water mixture. The separated water injected into the (lower) second reservoir 14*b* may be used to support pressure in a downhole fluid 22*b*. Maintaining said pressure may improve well performance of a second well 39, which is set up to retrieve downhole fluid 22*b* from second reservoir 14*b*, and minimize the need of treating facilities to treat downhole fluid 22*b*. A system as described in this specification may be particularly suited for us in remote offshore and onshore oil fields.

Figure 2A:
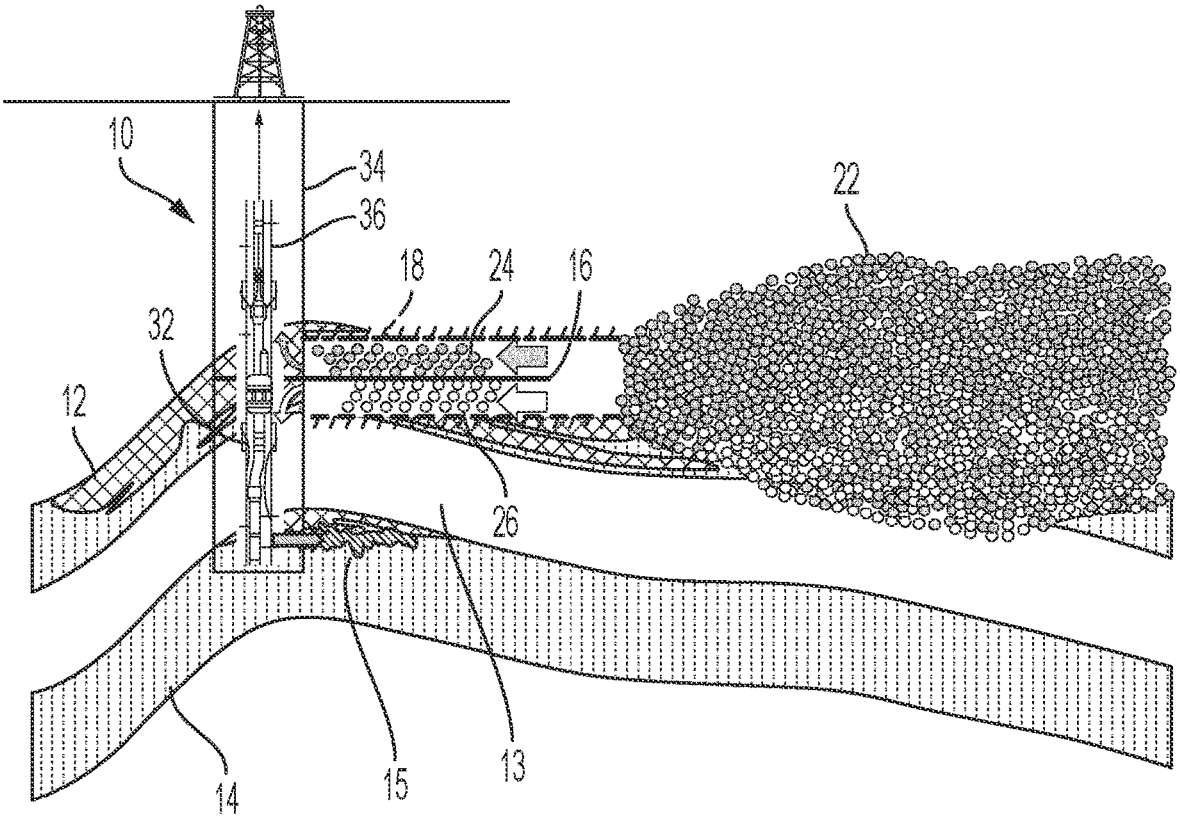
FIG. 2A is a cross-sectional view of a system with an inverted ESP and a horizontal casing liner with separator for processing downhole fluids from an upper reservoir and for injecting fluid into a lower reservoir of a hydrocarbon-bearing rock formations, according to aspects of the present embodiments.

Referring to FIG. 2A, an artificial lift system 36 may include an inverted ESP 32. Horizontal casing liner 18 may include a downhole separator 16 for separating downhole fluids 22 into a first material 24 and a second material 26.

Figure 2B:
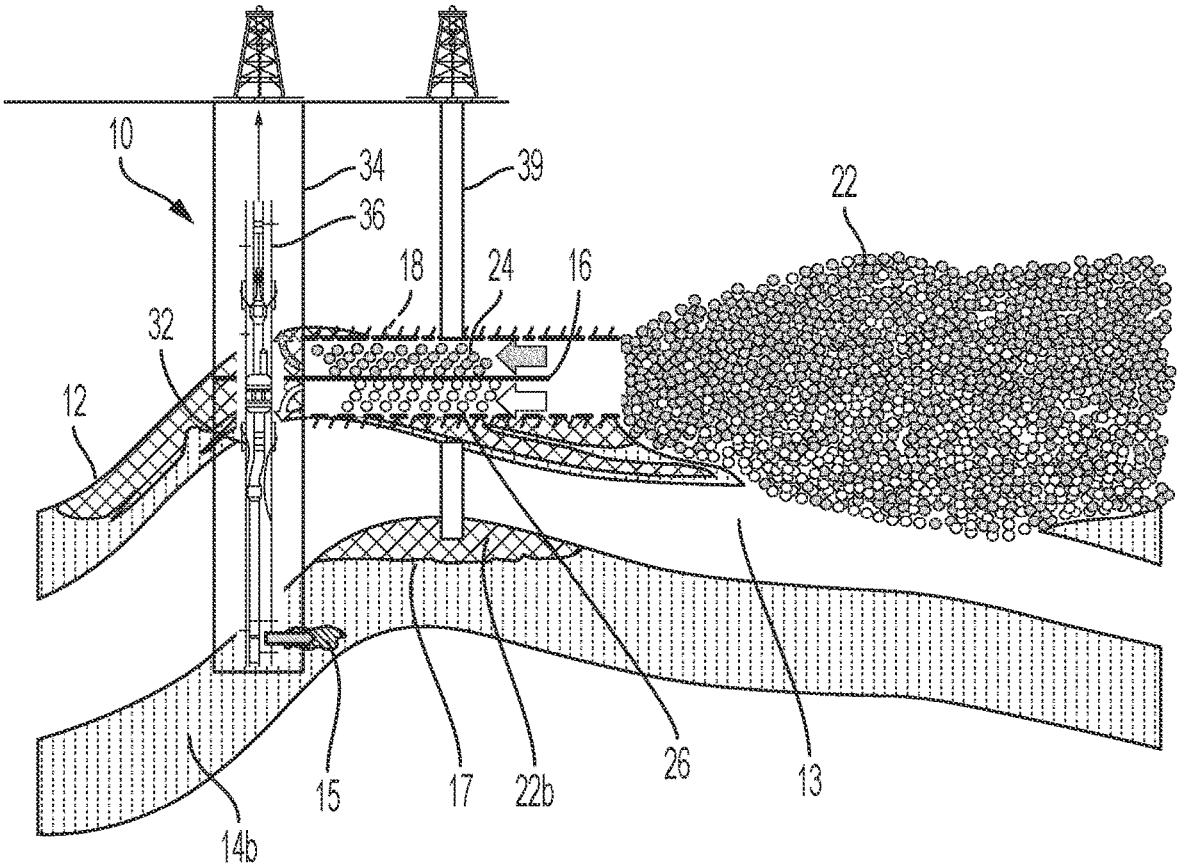
FIG. 2B is a cross-sectional view of the same system with a secondary wellbore to extract fluids from the lower reservoir.

First material 24 may be conveyed uphole without assistance by an ESP. Second material 26 may be directed to inverted ESP 32 for pumping/injecting fluid into second reservoir 14. In some embodiments, for example, as illustrated in FIG. 2B, second material 26 (for example, water) separated from downhole fluid 22, may be injected into second reservoir 14*b* near or below a water/oil contact line 17 between a (lower) water layer and a layer including a downhole fluid 22*b*, for example, oil or an oil-water mixture, for example, to support pressure in a downhole fluid 22*b*.

Figure 3A:
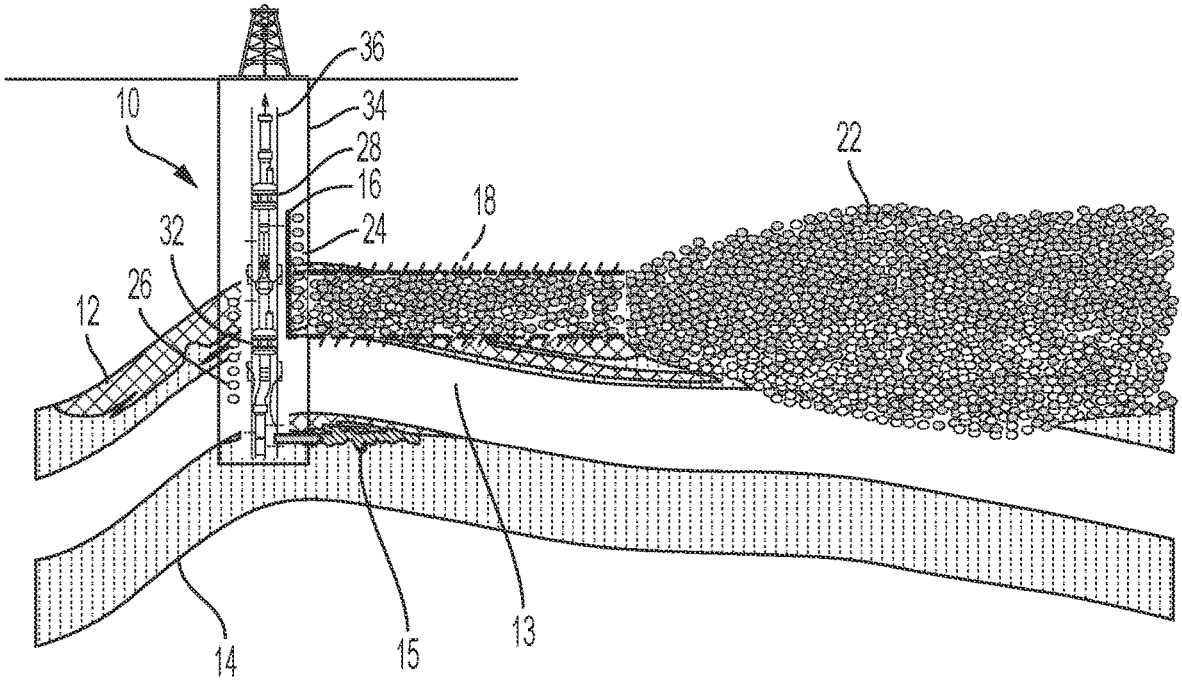
FIG. 3A is a cross-sectional view of a system with an electrical submersible pump (ESP), an inverted ESP, and a vertical separator for processing downhole fluids from an upper reservoir and for injecting fluid into a lower reservoir of hydrocarbon-bearing rock formations, according to aspects of the present embodiments.
Figure 3B:
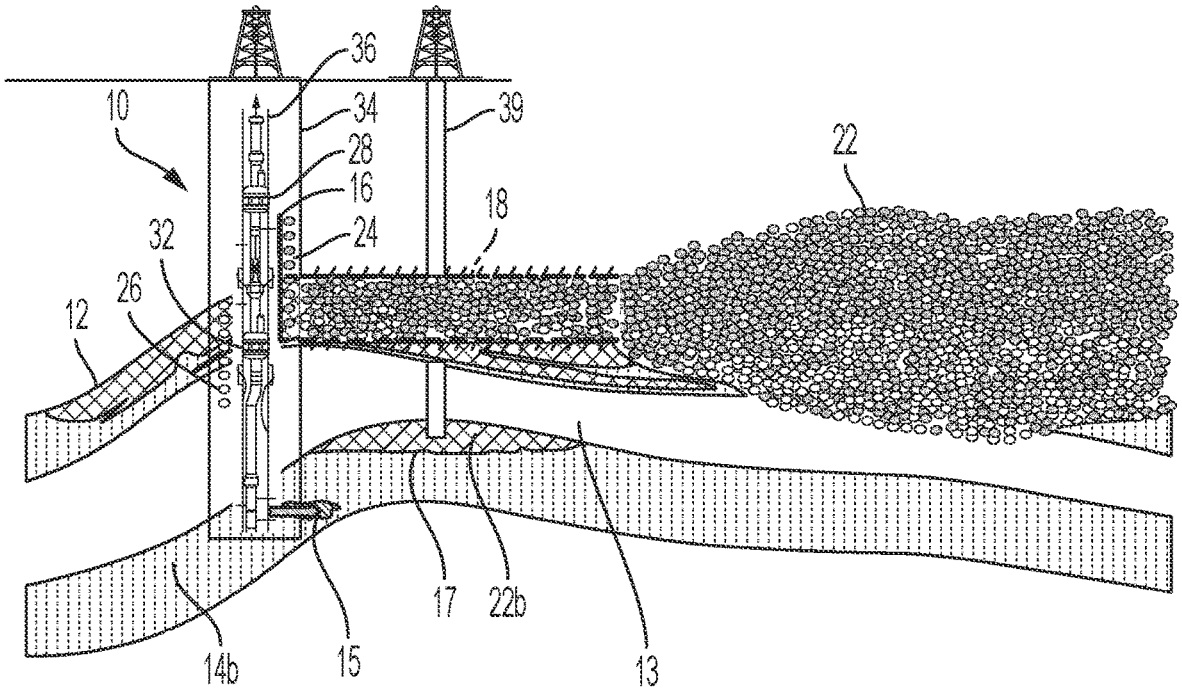
FIG. 3B is a cross-sectional view of the same system with a secondary wellbore to extract fluids from the lower reservoir.

Referring to FIG. 3A, an artificial lift system 36 may include both an ESP 28 and an inverted ESP 32. Downhole separator 16 may be disposed in a substantially vertical section of well 34, for example, at or near joint connecting casing liner 18 with well 34. First material 24 may be directed to ESP 28 for pumping to the surface, and second material 26 may be directed to inverted ESP 32 for pumping/injecting into second reservoir 14. In some embodiments, for example, as illustrated in FIG. 3B, second material 26 (for example, water) separated from downhole fluid 22, may be injected into second reservoir 14*b* near or below a water/oil contact line 17 between a (lower) water layer and a layer including a downhole fluid 22*b*, for example, oil or an oil-water mixture, for example, to support pressure in a downhole fluid 22*b*.

Figure 4A:
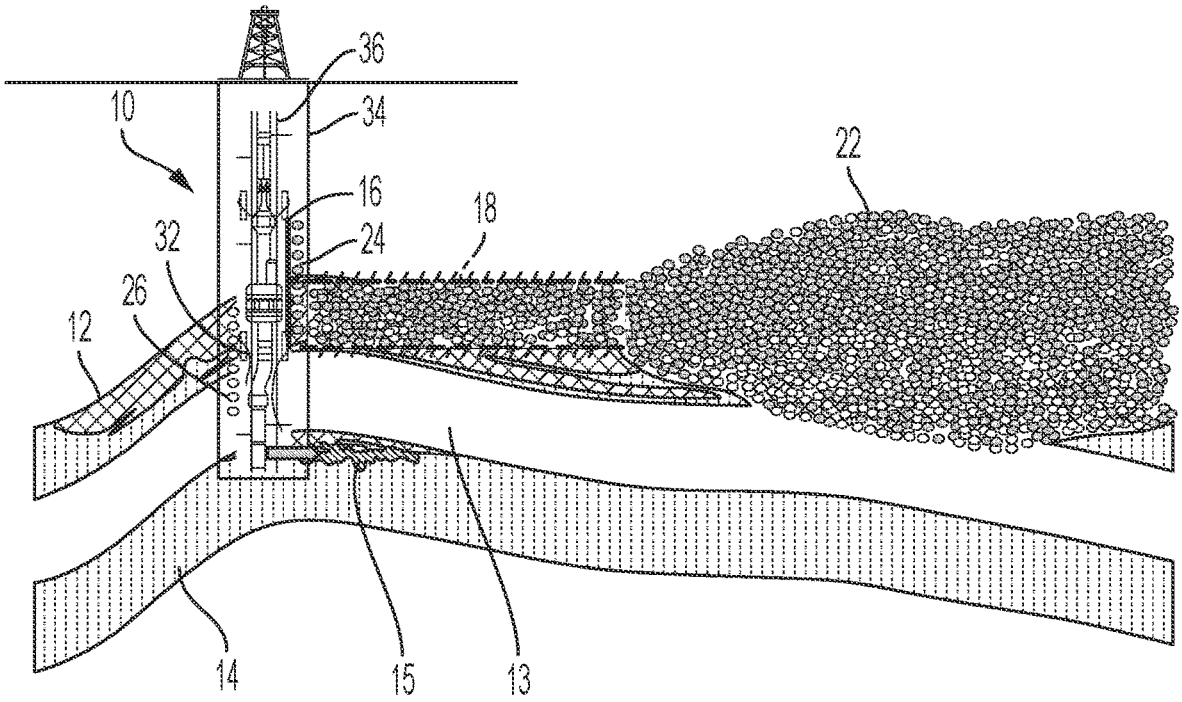
FIG. 4A is a cross-sectional view of a system with an inverted ESP and a vertical separator for processing downhole fluids from an upper reservoir and for injecting fluid into a lower reservoir of a hydrocarbon-bearing rock formations, according to aspects of the present embodiments.
Figure 4B:
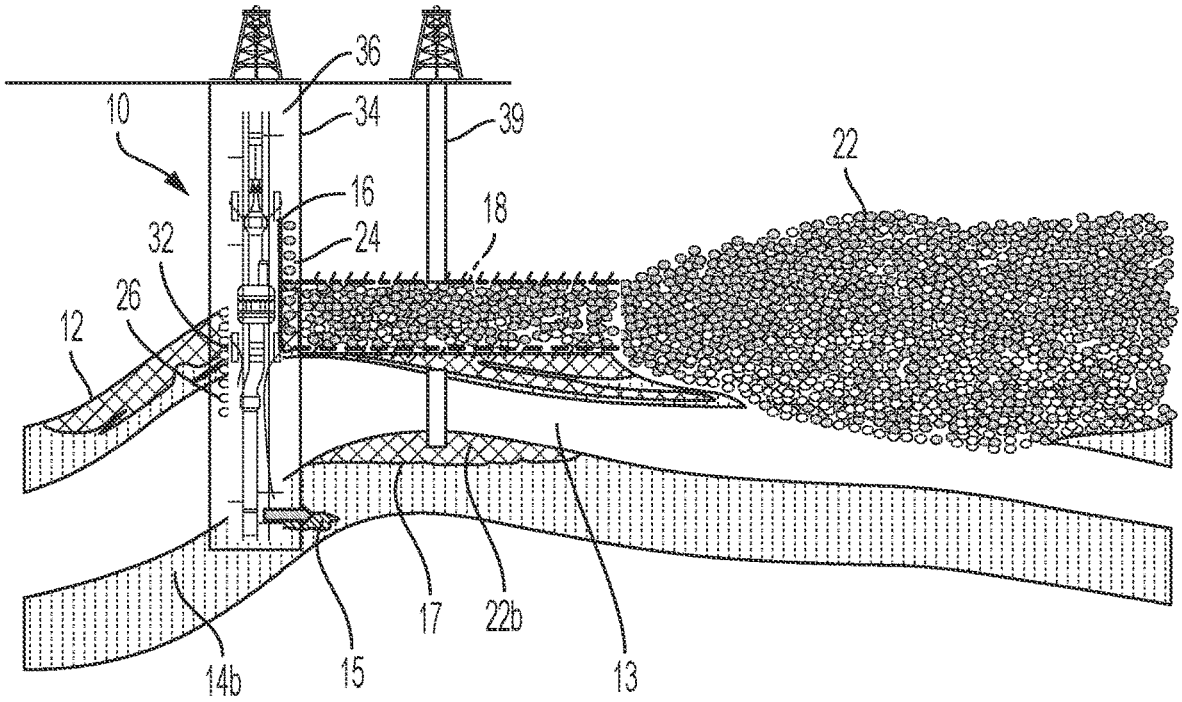
FIG. 4B is a cross-sectional view of the same system with a secondary wellbore to extract fluids from the lower reservoir.

Referring to FIG. 4A, an artificial lift system 36 may include an inverted ESP 32. Downhole separator 16 may be disposed in a substantially vertical section of well 34, for example, at or near joint connecting casing liner 18 with well 34. First material 24 may be conveyed uphole without assistance by an ESP. Second material 26 may be directed to inverted ESP 32 for pumping/injecting into second reservoir 14. In some embodiments, for example, as illustrated in FIG. 4B, second material 26 (for example, water) separated from downhole fluid 22, may be injected into second reservoir 14*b* near or below a water/oil contact line 17 between a (lower) water layer and a layer including a downhole fluid 22*b*, for example, oil or an oil-water mixture, for example, to support pressure in a downhole fluid 22*b*.

Figure 5:
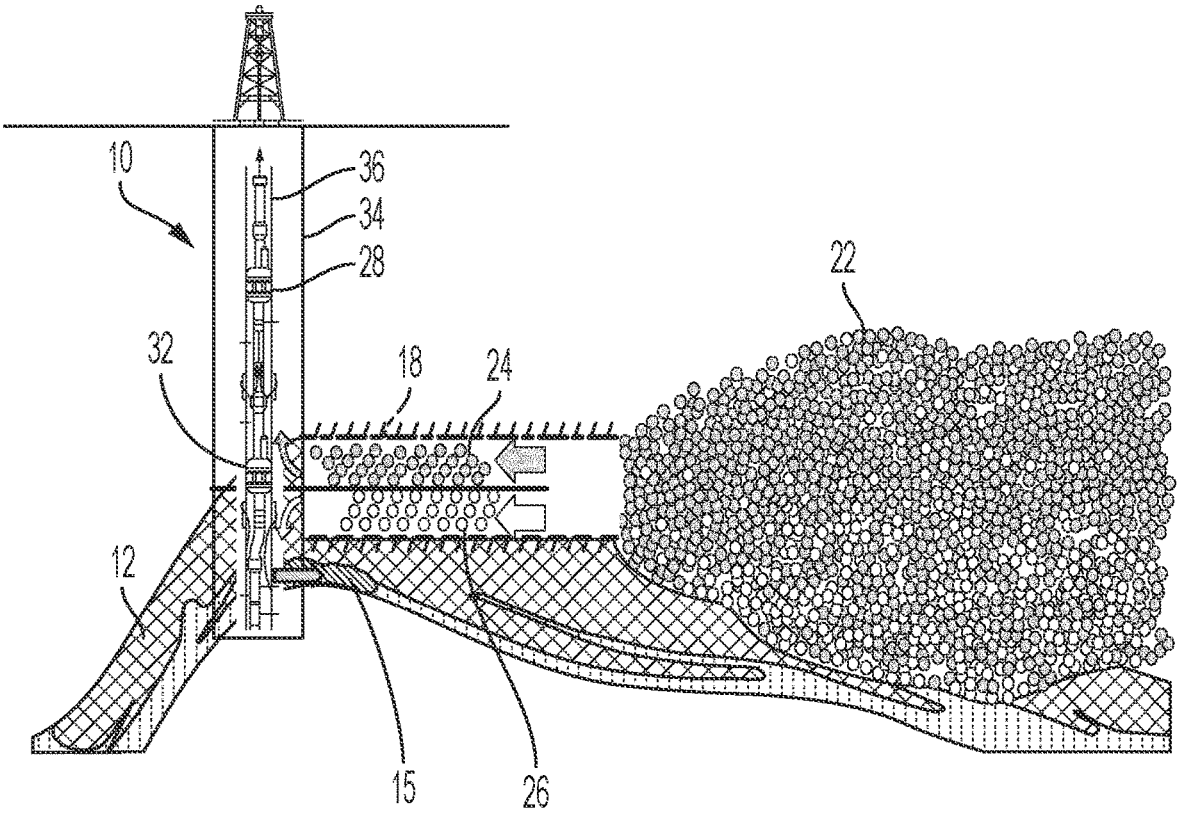
FIG. 5 is a cross-sectional view of a system with an electrical submersible pump (ESP), an inverted ESP, and a horizontal casing liner with separator for processing downhole fluids from a reservoir and for injecting fluid into a region at or near the bottom of the reservoir according to aspects of the present embodiments.

Referring to FIG. 5, an artificial lift system 36 may include both an ESP 28 and an inverted ESP 32 in a system adapted for use in a single reservoir. ESP 28 may push the first material 24 (for example, oil) from first reservoir 12 upward through the well 34. Inverted ESP 32 may pump (excessive) second material 26 (for example, water or gas) from first reservoir 12 into a region at or near the bottom of first reservoir 12, for example, a water layer, at a water injection zone 15. Any of the systems described in this specification, for example, the systems 10 as illustrated in FIGS. 1-4 may be used a system adapted for use in a single reservoir.

Figure 6:
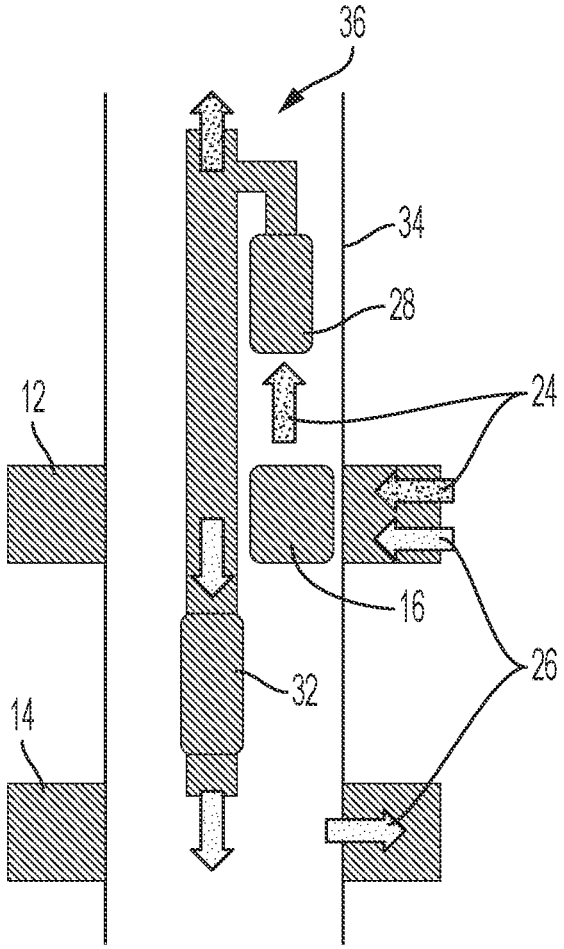
FIG. 6 is a cross-sectional schematic view of an artificial lift system, according to aspects of the present embodiments.

FIG. 6 is a cross-sectional schematic view of an example artificial lift system 36, according to aspects of the present embodiments. As noted supra, an artificial lift system 36 may be disposed within the well 34 for lifting at least one of the first and second materials, 24 and 26, uphole through the well 34 and may be disposed for injecting at least one of the first and the second materials, 24 and 26, into the second reservoir 14. The first and/or second materials 24 and 26 may include oil, water, or gas. The artificial lift system 36 may include at least one of an ESP 28 and an inverted ESP 32. The inverted ESP 32 may pump second material 26 (for example, excessive water and/or gas) to a lower zone (for example, second reservoir 14 or a lower region in the same reservoir, for example, reservoir 12), while the ESP 28 may push the first material 24 (for example, oil) upward or uphole through the well 34. The artificial lift system 36 may be operatively coupled to a downhole separator 16, where the downhole separator 16 may be substantially horizontal, tilted, or vertical.

Figure 7:
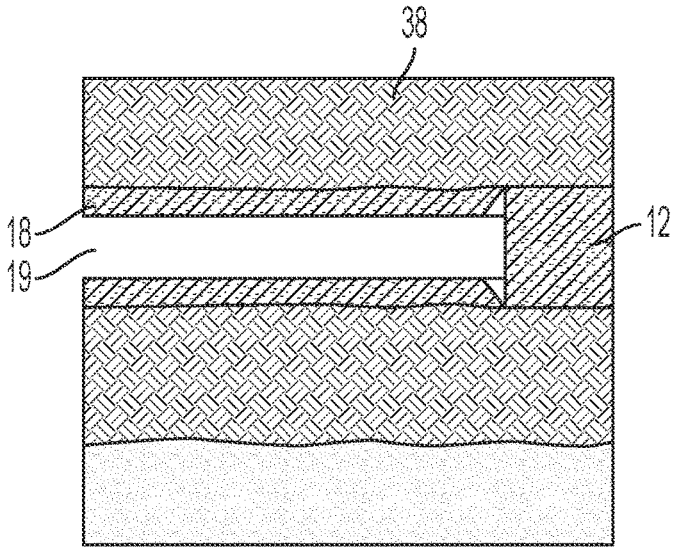
FIG. 7 is a cross-sectional view of a casing liner disposed in a hydrocarbon bearing rock formation, according to aspects of the present embodiments.

FIG. 7 is a cross-sectional view of an example casing liner 18 disposed in a hydrocarbon-bearing rock formation 38, according to aspects of the present embodiments. An example casing liner 18 may be disposed substantially horizontally in a reservoir, for example, a first reservoir 12. A casing liner 18 may be anchored and/or suspended at an open hole section of a well 34 and may be coupled to an artificial lift system (for example, as shown in FIGS. 1-5). In some embodiments, a casing liner 18 may include an inlet section 19. Inlet section 19 may anchor casing liner 18 in a section of a reservoir, for example, a first reservoir 12. Casing liner 18 may include or may encase a downhole separator 16, for example as shown in FIG. 8 and FIG. 9.

Figure 8:
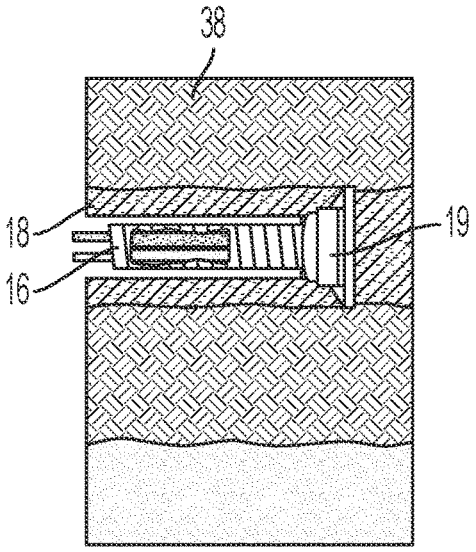
FIG. 8 is a partial cross-sectional view of an example downhole separator, according to aspects of the present embodiments.

FIG. 8 is a partial cross-sectional view of an example downhole separator 16 disposed substantively horizontally in a casing liner 18 in a hydrocarbon-bearing rock formation 38, according to aspects of the present embodiments. The downhole separator 16 may be a vessel, for example in a cylindrical shape. An example separator may be substantially horizontal (for example, as shown in FIGS. 1 and 2), tilted or substantially vertical (for example, as shown in FIGS. 3 and 4). A downhole separator 16 may be or may include a two-phase separator for separating oil and one of gas and water. A downhole separator 16 may be or may include a multi-phase separator for separating oil, water, gas, or other materials produced in he well. A downhole separator 16 may operate at a specified operating pressure or a specified residence time of the fluid mixture. In some embodiments, the operating pressure may be 10-2000 pounds per square inch (psi), 100-1500 psi, 200-1500 psi, 300-1000 psi, or 500-800 psi. In some embodiments, the residence time may be between 0.5 and 100 seconds, between 1 and 60 seconds, between 1 and 30 second, or between 1 and 10 seconds in a control volume of 1 cubic centimeter. A downhole separator 16 may separate a flow of fluids (for example, a mixture of two or more of oil, water, and gas) in a substantially horizontal direction (FIGS. 1 and 2) or vertical direction (FIGS. 3 and 4). A downhole separator 16 may include at least a hydro cyclone, a water sink, or a separation barrier. Additional hydro cyclones may be included in a vertical section of an artificial lift system as described in this specification.

Figure 9:
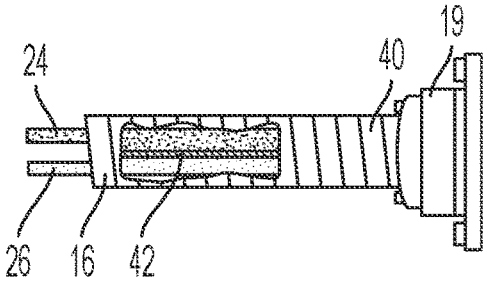
FIG. 9 is a partial cross-sectional view of an example downhole separator disposed in a casing liner, according to aspects of the present embodiments.

FIG. 9 is a partial cross-sectional view of the downhole separator 16 shown in FIG. 8. Downhole fluids may enter the downhole separator 16 horizontally and flow through a series of devices (for example, membranes, cyclones, or Autonomous Inflow Control Devices (AICD)) at a separator inlet portion 40. In some embodiments, downhole separator 16 may include a separation barrier 42 that may separate oil and water. In some embodiments, separation barrier 42 may include a (horizontal) membrane that may be moveable in a direction substantially perpendicular to the direction of flow, for example, in a vertical direction. In some embodiments, the (horizontal) membrane may separate fluids, for example, oil and water, into two (horizontal) streams. In some embodiments, gas may be conveyed on an upper or uphole side of the membrane, and oil or water may be conveyed on a lower downhole side of the membrane. In some embodiments, oil may be conveyed on an upper or uphole side of the membrane, and water may be conveyed on a lower or downhole side of the membrane. A separation barrier 42 may be actively moveable (for example, hydraulically or using an electric motor), for example, based on inflowing fluid properties. Separation barrier 42 may be connected to a motor, a control system, and one or more sensors, for example, a density sensor, a viscosity sensor, or a multiphase meter (for example, to determine oil/water ratio). In some embodiments, the sensors are mounted on the separation barrier 42. In some embodiments, the sensors are mounted on a membrane, a cyclone, or an AICD. One or more meters (for example, a mechanical meter or an orifice meter) may be used to measure total amounts of fluid or may be used to measure amounts of oil, water, or gas individually as they exit the downhole separator 16 through separate outflow lines. In some embodiments, mechanical meters measure amount of oil or water; an orifice meter measures the gas. The degree of separation (and thus the efficacy of a downhole separator) may depend on factors such as separator operating pressure, residence time of the fluid mixture, and the type of flow of fluids (for example, turbulent flow or laminar flow). In some embodiments, gravity may be used to separate oil and water based on the different densities between the fluids (that is, oil is lighter than water). Gravity-based separation may be used alone or in combination with the separation techniques describe supra. A downhole separator may be disposed at the openhole section of a well for downhole fluids to enter and flow though. After separation, fluids may be pumped through the well (for example, uphole and/or downhole) as described supra.

Figure 10:
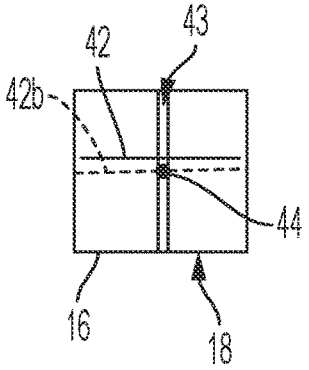
FIG. 10 is a cross-sectional schematic view of a separation barrier in a phase separator, according to aspects of the present embodiments.

FIG. 10 is a cross-sectional schematic view of a movable separation barrier 42 in an example phase separator 16, according to aspects of the present embodiments. The separation barrier 42 may move in a direction substantially perpendicular to a main direction of flow. For example, the separation barrier 42 may move in a vertical direction, for example, up or down from a first position to a second position (for example, as indicated by dashed line 42*b*) within the downhole separator for providing suitable spaces for each separated fluid. Separation barrier 42 may remain substantially parallel to casing liner 18 during movement. In some implementations, separation barrier 42 may be mounted on a hinge or on a slotted track, or both. An example slotted track 43 may allow vertical (up/down) movement of separation barrier 42 that is mounted in or on track 43 via a sliding hinge 44. In some implementations, an example slotted track may allow horizontal movement of separation barrier 42, for example, horizontal movement parallel to or perpendicular to a longitudinal axis of a cylindrical separator 16. In some implementations, a slotted track or a hinge (or both) may include one or more motors to move separation barrier 42. In some implementations, a slotted track or a hinge (or both) may include one or more sensors connected to the one or more motors and a control unit to enhance the accuracy of movement, for example, upward or downward movement. Movement of separation barrier 42 may be based on one or more physical or chemical properties (for example, viscosity or density) of downhole fluids (for example, oil, water, or gas) that may be measured by sensors coupled to the separation barrier 42, or a ratio of an amount of the first material to the second material, or a combination thereof. The separation barrier 42 may be operatively coupled to a downhole dual- or multi-phase meter, which may identify or track movement of the separation barrier. In some embodiments, the ratio of the first material to the second material is between 1:100 and 1:1, between 1:50 and 1:1, between 1:10 and 1:1; between 1:5 and 1:1, between 1:2 and 1:1, between 1:1 and 100:1, between 1:1 and 50:1, between 1:1 and 10:1; between 1:1 and 5:1, or between 1:1 and 1:2.

Figure 11:
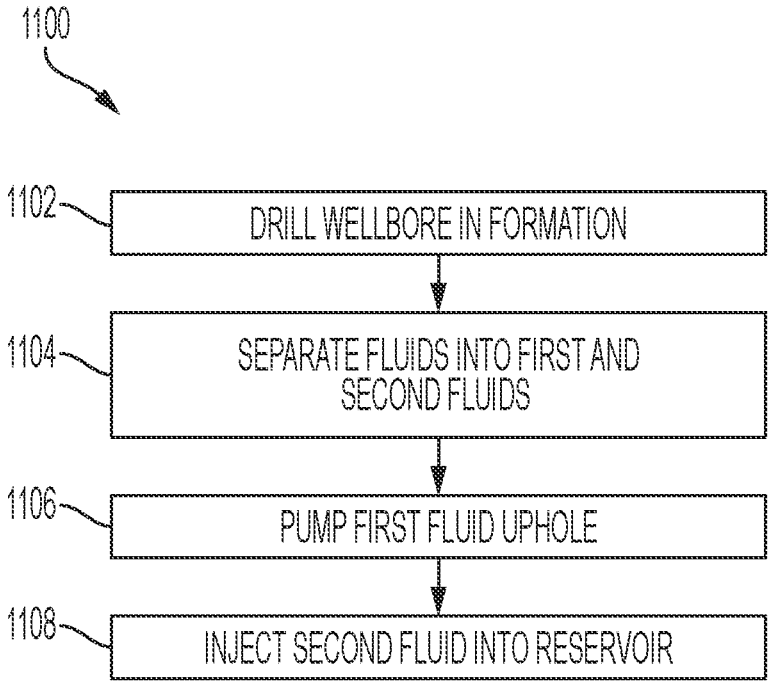
FIG. 11 is a flow chart for a method for processing fluids in hydrocarbon-bearing rock formations, according to aspects of the present embodiments.

FIG. 11 shows a flow diagram illustrating a method 1100 for processing materials in a wellbore in a hydrocarbon-bearing rock formation. At step 1102, the method 1100 may include drilling a wellbore, where the wellbore may be operatively coupled to a flank of a first reservoir and a flank of a second reservoir. For example, the wellbore may be drilled at a phase contact (for example, oil-water or oil-gas contact) of a second, lower reservoir for producing oil from a first, upper reservoir and injecting water or gas into the flank or vicinity of a phase contact of the lower reservoir. In some embodiments, the first reservoir may be located at a greater depth than the second reservoir. At step 1104, the method 1100 may include separating a flow of materials into at least a first material (first fluid) and a second material (second fluid), where the flow of materials may enter the well through the flank of the first reservoir. The flow of materials may include oil, water, or gas, or a combination of two or more of oil, water, and gas. At least one downhole separator may be used for separating a flow of materials. At step 1106, the method 1100 may include pumping at least one of the first material and the second material through the well. In some embodiments, step 1106 may include pumping the first material uphole through the well. At step 1108, the method 1100 may include injecting the second material into the second reservoir. An artificial lifting system comprising at least one of an ESP and an inverted ESP may be used for pumping the first material, injecting the second material, or both.

Certain Definitions

In order for the present disclosure to be more readily understood, certain terms are first defined below. Additional definitions for the following terms and other terms are set forth throughout the specification.

As used herein, "a" or "an" with reference to a claim feature means "one or more," or "at least one."

As used herein, the term "substantially" refers to the qualitative condition of exhibiting total or near-total extent or degree of a characteristic or property of interest.

EQUIVALENTS

It is to be understood that while the disclosure has been described in conjunction with the detailed description thereof, the foregoing description is intended to illustrate and not limit the scope of the invention(s). Other aspects, advantages, and modifications are within the scope of the claims.

This written description uses examples to disclose the invention, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed:

1. A fluid processing system for use in a wellbore in a hydrocarbon-bearing rock formation, the system comprising:

a casing liner disposed in an open hole section of a well for providing a separation zone in a flow of materials from a first reservoir, the flow of materials comprising at least a first material and a second material; and a downhole separator operatively coupled to the casing liner for separating the first material and the second material within the flow of materials;

wherein the downhole separator further comprises a separation barrier, where the separation barrier is movable within the downhole separator.

2. The system of claim 1, further comprising:

an artificial lift system operatively coupled to the downhole separator, where the artificial lift system is disposed within the well for lifting at least one of the first and second materials uphole through the well or for injecting at least one of the first and the second materials into a second reservoir.

3. The system of claim 2, where the artificial lift system is or comprises at least one of an electrical submersible pump (ESP) and an inverted ESP.

4. The system of claim 2, where the second reservoir is located at a greater depth than the first reservoir.

5. The system of claim 2, where the first reservoir and the second reservoir are lateral reservoirs.

6. The system of claim 1, where the first material is or comprises oil.

7. The system of claim 1, where the second material is or comprises gas or water.

8. The system of claim 1, where the downhole separator is or comprises at least one of a hydro cyclone and a water sink.

9. The system of claim 1, where the downhole separator separates the flow of materials in a substantially horizontal direction.

10. The system of claim 1, where the downhole separator separates the flow of materials in a substantially vertical direction.

11. The system of claim 1, where the separation barrier is movable based on a ratio of an amount of the first material to the second material.

12. The system of claim 1, where the downhole separator is disposed at the open hole section of the well.

13. A method for processing materials in a wellbore in a hydrocarbon-bearing rock formation, comprising:

drilling a wellbore, where the wellbore is operatively coupled to a flank of a first reservoir and a flank of a second reservoir;

separating a flow of materials into at least a first material and a second material using a downhole separator, where the flow of materials enter the well through the flank of the first reservoir and wherein the downhole separator comprises a separation barrier, where the separation barrier is movable within the downhole separator;

pumping at least one of the first material and the second material through the well; and injecting the second material into the second reservoir.

14. The method of claim 13, where the first reservoir is located at a greater depth than the second reservoir.

15. The method of claim 13, where the flow of materials comprises at least one of oil, water, and gas.

16. The method of claim 13, where the first material is or comprises oil.

17. The method of claim 13, where the second material is or comprises gas or water.

18. The method of claim 13, where pumping the first material uphole through the well and injecting the second material into the second reservoir comprises using an artificial lifting system, where the artificial lifting system is or comprises at least one of an ESP and an inverted ESP.

* * * * *